US006203139B1

(12) United States Patent
Beauchamp

(10) Patent No.: US 6,203,139 B1
(45) **Date of Patent: *Mar. 20, 2001**

(54) CARRIAGE RANDOM VIBRATION

(75) Inventor: Robert W. Beauchamp, Carlsbad, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/985,641

(22) Filed: Dec. 5, 1997

(51) Int. Cl.[7] ..... B41J 2/01
(52) U.S. Cl. ..... 347/37; 347/44
(58) Field of Search ..... 347/20, 37, 40, 347/44, 47, 68, 74, 78

(56) References Cited

U.S. PATENT DOCUMENTS

| | | | | |
|---|---|---|---|---|
| 4,420,764 | * | 12/1983 | Okada | 347/40 |
| 5,193,922 | | 3/1993 | Hayashi | 400/157.1 |
| 5,363,131 | * | 11/1994 | Momose et al. | 347/46 |
| 5,608,439 | * | 3/1997 | Arbeiter et al. | 347/102 |

FOREIGN PATENT DOCUMENTS

| | | | | |
|---|---|---|---|---|
| 60048368 | * | 8/1983 | (EP) | B41J/3/04 |
| 58-199166 | * | 11/1983 | (JP) | B41J/3/04 |

OTHER PUBLICATIONS

European Search Report mailed Mar. 12, 1999 re European Patent Application 98309422.

Patent Abstracts of Japan, vol. 8, No. 043, (M–279) re Publication JP 58199166 of Application JP 57082645; Nov. 19, 1983.

Patent Abstracts of Japan, vol. 7, No. 211 (M–243) re Publication JP 58107356 of Application No. 56205495; Jun. 27, 1983.

Patent Abstracts of Japan, vol. 7, No. 211 (M–243) re Publication JP 58107359 of Application JP 56205494; Jun. 27, 1983.

Patent Abstracts of Japan, vol. 11, No. 301 (M–628) re Publication JP 60048368 of Application JP 58156687; Mar. 16, 1985.

Patent Abstracts of Japan, vol. 9, No. 179 (M–399) re Publication JP 62092866 of Application JP 60231395; Apr. 28, 1987.

Patent Abstracts of Japan, vol. 12, No. 434 (M–764) re Publication JP 63170060 of Application JP 62001595; Jul. 13, 1988.

* cited by examiner

*Primary Examiner*—N. Le
*Assistant Examiner*—Anh T. N. Vo
(74) *Attorney, Agent, or Firm*—Manuel Quiogue

(57) ABSTRACT

An ink jet printer that includes a movable print carriage for reciprocatingly scanning along a carriage scan axis, a printhead having a plurality of ink jet nozzles and supported by the movable print carriage, a print media moving mechanism for moving print media along a media axis through a print zone, and a vibration inducing piezoelectric element for causing relative vibration between the printhead and the print media such that locations along a media axis of dots printed by the ink jet nozzles are minutely randomly varied to reduce otherwise visible banding caused by poor paper advance or misdirected nozzles.

24 Claims, 3 Drawing Sheets

CARRIAGE RANDOM VIBRATION

BACKGROUND OF THE INVENTION

The disclosed invention relates to ink jet printing devices, and more particularly to techniques for improving print quality.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable print carriage that supports one or more printheads each having ink ejecting nozzles. The print carriage traverses back and forth over the surface of the print medium, and the nozzles are controlled to eject drops of ink at appropriate times pursuant to command of a microcomputer or other controller, wherein the timing of the application of the ink drops is intended to correspond to the pattern of pixels of the image being printed. Typically, a plurality of rows of pixels are printed in each traverse or scan of the print carriage. The particular ink ejection mechanism within the printhead may take on a variety of different forms known to those skilled in the art, such as those using thermal printhead or piezoelectric technology. For instance, two earlier thermal ink jet ejection mechanisms are shown in commonly assigned U.S. Pat. Nos. 5,278,584 and 4,683,481. In a thermal system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. Upon heating, an ink droplet is ejected from a nozzle associated with the energized heater element. By selectively energizing heater elements as the printhead moves across the print medium, ink drops are ejected onto the print medium in a pattern to form the desired image.

A consideration of scanning carriage ink jet printers is the visible banding caused by poor paper advance or misdirected ink nozzles. Such banding has been addressed by software randomization. However, software randomization has been found to require multiple passes, wherein the number of passes increases with the inaccuracy of the paper advance. This significantly reduces throughput.

SUMMARY OF THE INVENTION

It would therefore be an advantage to provide an ink jet printer having reduced print banding caused by poor paper advance or misdirected nozzles.

Another advantage would be to provide print banding reduction that does not substantially reduce throughput.

The foregoing and other advantages are provided by the invention in a printer that includes a movable print carriage for reciprocatingly scanning along a carriage scan axis, a printhead having a plurality of printing elements and supported by the movable print carriage, a print media moving mechanism for moving print media along a media axis through a print zone, and a vibration inducing element for causing relative vibration between the printhead and the print media such that locations along the media axis of dots printed by the printing elements are minutely randomly varied. In accordance with a specific implementation of the invention, the vibration inducing element includes a piezoelectric element.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
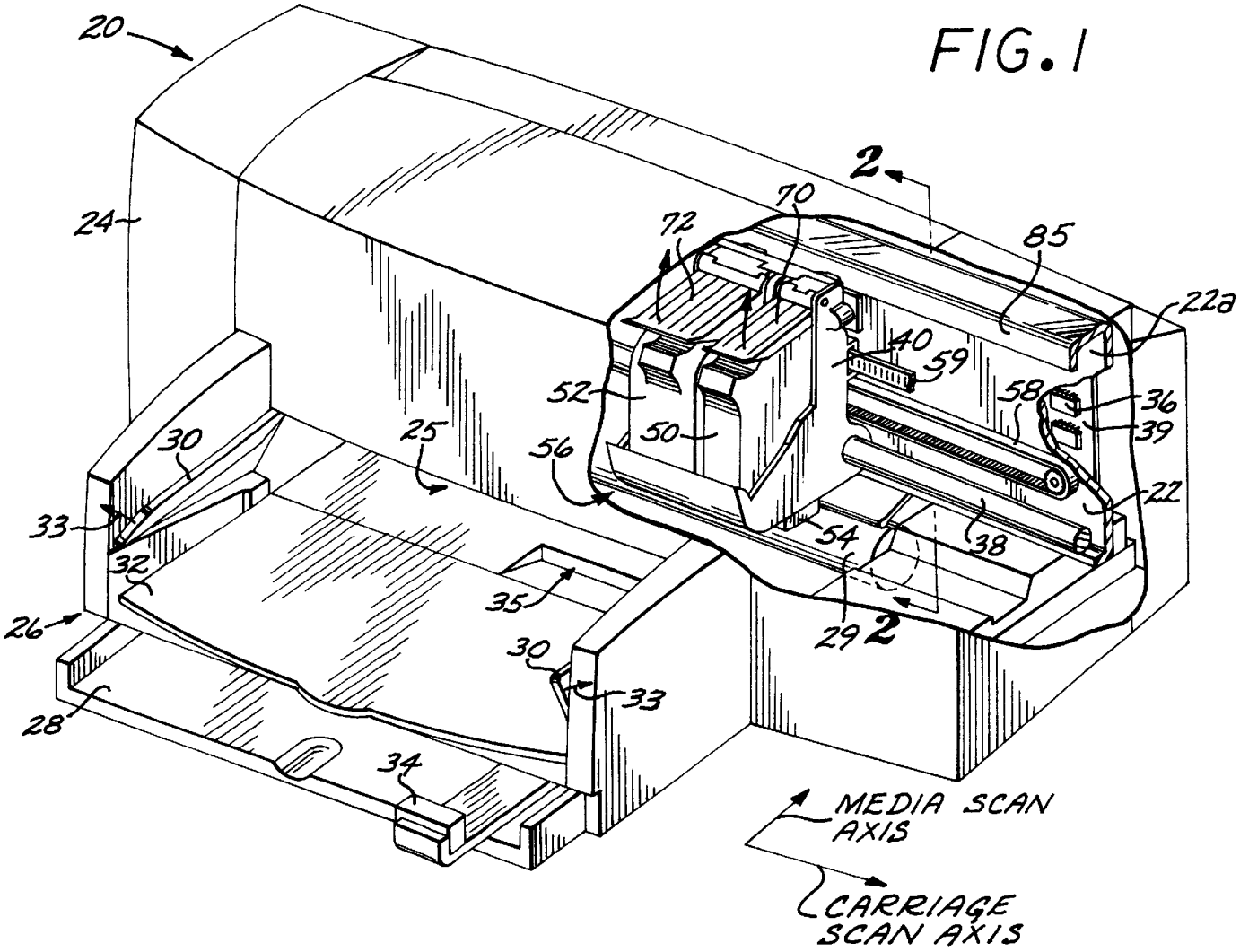
FIG. 1 is a partially fragmented schematic perspective view of an ink jet printing mechanism that employs random noise vibration in accordance with the invention.

In the following detailed description and in the several figures of the drawing, like elements are identified with like reference numerals.

Referring now to FIG. 1, set forth therein is a schematic partially fragmented perspective view depicting, by way of illustrative example, major mechanical components of a swath type ink jet printer 20 employing random noise vibration in accordance with the invention. The printer includes a chassis 22 surrounded by a housing or enclosure 24, typically of a molded plastic material. The chassis 22 is formed for example of sheet metal and includes a vertical panel 22*a*. An example of a printer in which the invention can be implemented is the Hewlett-Packard Company's DeskJet 722 brand ink jet printer.

Figure 2:
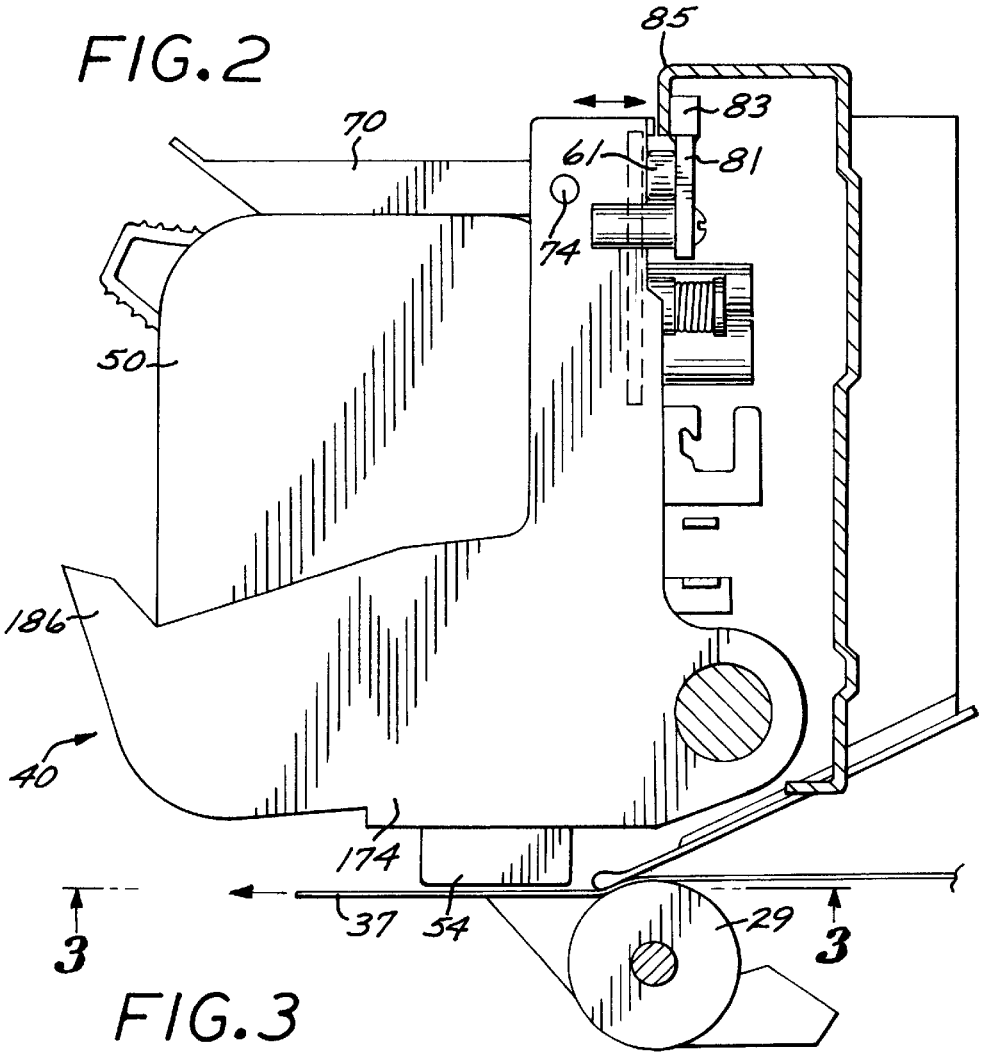
FIG. 2 is a side elevational view of the print carriage of the printing mechanism of FIG. 1.
Figure 3:
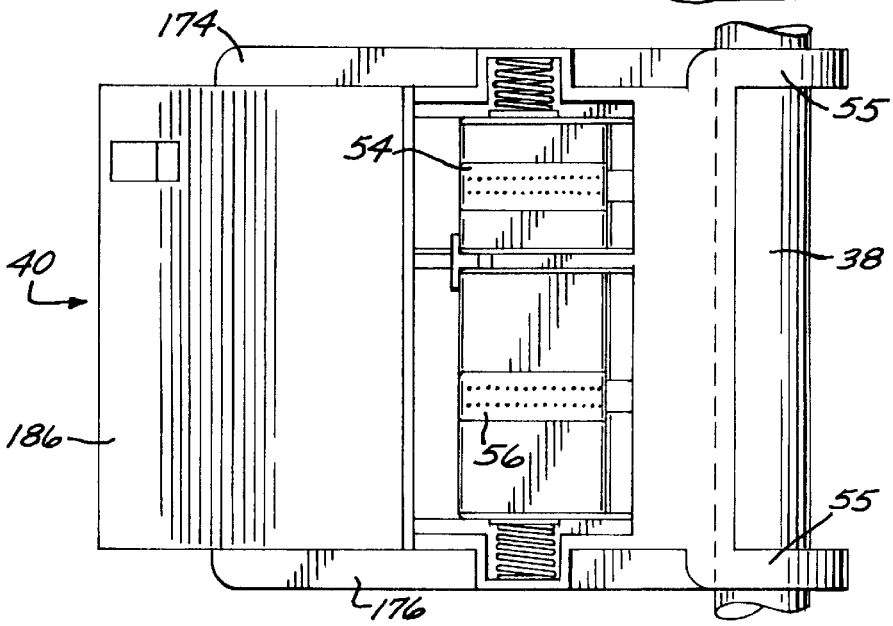
FIG. 3 is a bottom plan view of the print carriage of the printing mechanism of FIG. 1 showing the printheads of the print cartridges disposed in the print carriage.

Sheets of print media are individually fed through a print zone 25 by an adaptive print media handling system 26 that includes a feed tray 28 for storing print media before printing. The print media may be any type of suitable printable sheet material such as paper, card-stock, transparencies, mylar, and the like, but for convenience the illustrated embodiments described as using paper as the print medium. A series of conventional motor-driven rollers including a drive roller 29 driven by a stepper motor may be used to move print media from the feed tray 28 into the print zone 25, as shown in FIG. 2 for sheet 37, for printing. After printing, the drive roller 29 drives the printed sheet onto a pair of retractable output drying wing members 30 which are shown extended to receive a printed sheet. The wing members 30 hold the newly printed sheet for a short time above any previously printed sheets still drying in an output tray 32 before pivotally retracting to the sides, as shown by curved arrows 33, to drop the newly printed sheet into the output tray 32. The print media handling system may include a series of adjustment mechanisms for accommodating different sizes of print media, including letter, legal, A-4, envelopes, etc., such as a sliding length adjustment arm 34 and an envelope feed slot 35.

The printer of FIG. 1 further includes a printer controller 36, schematically illustrated as a microprocessor, disposed on a printed circuit board 39 supported on the rear side of the chassis vertical panel 22*a*. The printer controller 36 receives instructions from a host device such as a personal computer (not shown) and controls the operation of the printer including advance of print media through the print zone 25 and the ink jet printing of dots, discussed further herein.

A print carriage slider rod 38 having a longitudinal axis parallel to a carriage scan axis is supported by the chassis 22 to slideably support a print carriage 40 for reciprocating translational movement or scanning along the carriage scan axis.

As more particularly shown in FIGS. 2–5, the print carriage 40 more particularly includes a body portion 75 having a rear wall 185, a front apron 186, and L-shaped side walls 174, 176 that extend forwardly from lateral edges of the rear wall 185 to lateral edges of the front apron 186. An alignment wall or web 76 divides an interior portion of the carriage body into first and second chambers 80, 82 which respectively house first and second removable ink jet printhead cartridges 50, 52 (each of which is sometimes called a "pen," "print cartridge," or "cartridge"). The print cartridges 50, 52 include respective printheads 54, 56 that respectively have generally downwardly facing nozzles for ejecting ink generally downwardly onto a portion of the print media 37 that is in the print zone 25. A latch mechanism that includes clamping levers, latch members or lids 70, 72 pivotally attached by a hinge 74 to the body portion 75 of the print carriage 51 cooperatively acts with the print carriage body 75 and the print cartridges 50, 52 to clamp the cartridges 50, 52 in the chambers 80, 82.

An illustrative example of a suitable print carriage is disclosed in commonly assigned U.S. application Ser. No. 08/757,009, filed Nov. 26, 1996, Harmon et al., incorporated herein by reference.

For reference, the print media 37 is advanced through the print zone 25 along a media axis which is parallel to the tangent to the portion of the print media 37 that is beneath and traversed by the nozzles of the cartridges 50, 52. If the media axis and the carriage axis are located on the same plane, as shown in FIG. 1, they would be perpendicular to each other.

The print carriage 40 further includes a pair of bearings 55 which slidably support the print carriage 40 as it slides along the slider rod 38. A vertical anti-rotation guide arm 81 is attached to the back of the rear wall 185 of the print carriage body 75 and includes a slide bushing 83 that engages a horizontally disposed anti-pivot bar 85 that is formed integrally with the vertical panel 22*a* of the chassis 22, for example. The bearings 55 and the slide bushing 83 provide a three-point carriage support system; and the vertical anti-rotation guide arm 81, the slide bushing 83 and the horizontal anti-pivot bar 85 cooperate to prevent forward pivoting of the print carriage 40 about the slider rod 38.

By way of illustrative example, the print cartridge 50 is a monochrome printing cartridge while the print cartridge 52 is a tri-color printing cartridge. Alternatively, discrete monochrome cartridges may be used.

The print carriage 40 is driven along the slider rod 38 by an endless belt 58 which can be driven in a conventional manner, and a linear encoder strip 59 is utilized to detect position of the print carriage 40 along the carriage scan axis, for example in accordance with conventional techniques.

In accordance with the invention, a vibration inducing element that vibrates at a frequency in the range of about 100 Hz to about 1000 Hz is provided to induce a vibration of very small amplitude along the media axis between the printheads and the print media as the carriage traverses the print media. By way of illustrative example, the vibration inducing element comprises a piezoelectric element 61 disposed between the vertical guide arm 81 and the rear wall 185 of the carriage body 75. A voltage is applied to the piezoelectric element 61 which causes the carriage 40 to rotationally vibrate about the slider rod 38. As a result of such rotational vibration, the aim or direction of the nozzles of the printheads 54, 56 is vibrationally angularly varied over a small angle in a plane that is orthogonal to the media carriage axis. As a result of the vibrational angular variation, the potential placement of dots along the media axis is vibratingly varied over a small interval, whereby the actual placement of dots along the media axis is vibratingly varied over such small interval. By way of illustrative example, the print carriage 40 and the piezoelectric element are configured to provide a dot placement variation of about 0.25 of 1/1000th of an inch (sometimes called 0.25 mils).

Effectively, the invention contemplates introducing a small amount of mechanical noise into the placement of dots along the media axis, which reduces visible banding that would otherwise be caused by less than optimal paper advance or nozzle aim since the small amount of mechanical noise vibrates the placement of the dots that would otherwise define the bands. It should be appreciated that the sharpness of the printed image may be slightly degraded in exchange for reduced banding, and vibration inducing element may be selectively enabled and disabled.

Figure 4:
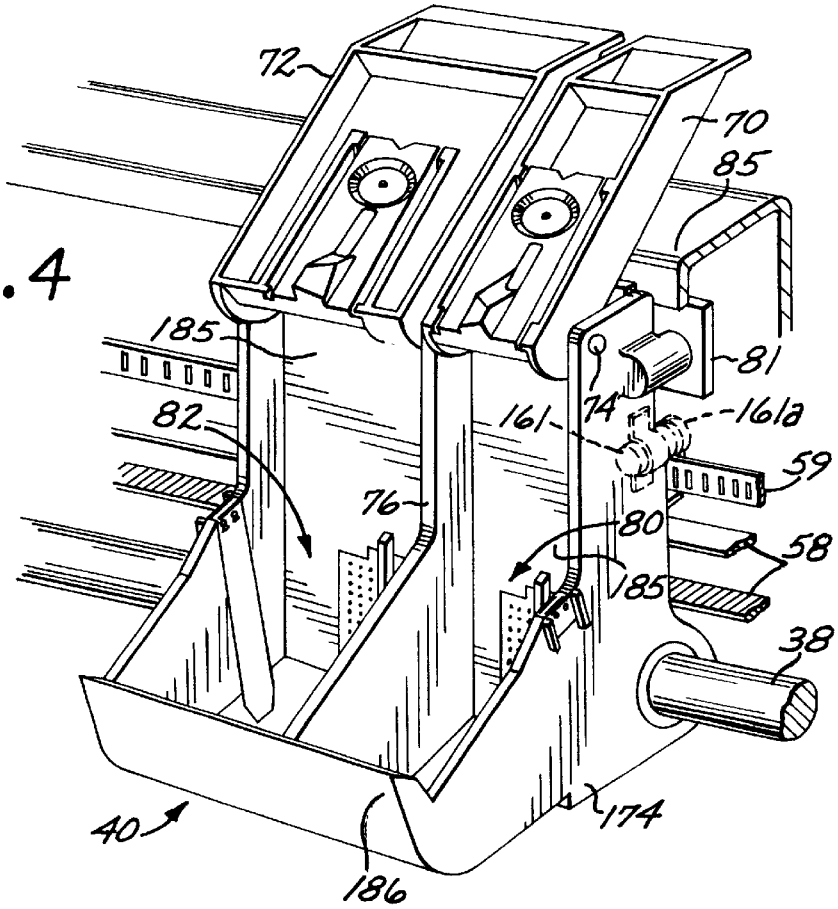
FIG. 4 is a schematic perspective view of the print carriage of the printing mechanism of FIG. 1.
Figure 5:
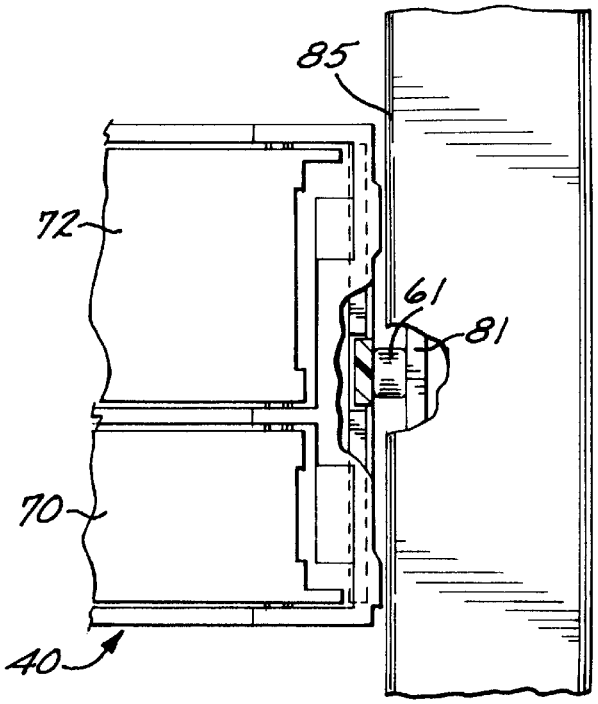
FIG. 5 is a top plan view of the print carriage of the printing mechanism of FIG. 1.

While a piezoelectric element is disclosed as the vibrational noise introducing element, other apparatus such as a small electric eccentric motor (frequently used in pagers as a silent vibrator) can be used. As shown in FIG. 4 by way of illustrative example, a small eccentric motor 161, schematically depicted in broken lines, can be conveniently attached to the wall 174 of the carriage body 40. Operation of the motor 161, which includes an eccentric load or mass 161*a*, causes micro-rotation of the carriage 40 about the slider rod 38 which in turn causes micro-displacement the placement of the printed dots.

The foregoing has been a disclosure of an ink jet printer that advantageously utilized mechanical noise to reduce banding caused by poor paper advance or misdirected ink jet nozzles, and more generally of a mechanical print banding reducing technique that is readily adapted to various printers.

Although the foregoing has been a description and illustration of specific embodiments of the invention, various modifications and changes thereto can be made by persons skilled in the art without departing from the scope and spirit of the invention as defined by the following claims.

What is claimed is:

1. A printer having reduced visible print banding, comprising:

a movable print carriage for reciprocatingly scanning along a carriage scan axis;

a removable printhead supported by said movable print carriage during printing operations and having a plurality of printing elements for printing dots on print media in a print zone;

a print media handling system for advancing print media along a media scan axis to the print zone; and a carriage vibration inducing element attached to the carriage for causing said carriage to vibrate relative to the print media in the print zone such that locations along the media scan axis of the dots printed by said printing elements are minutely randomly varied to reduce visible print banding caused by less than optimum print media advance or by misdirection of the printing elements.

2. The printer of claim 1 wherein said vibration inducing element vibrates at a frequency in a range of about 100 Hz to about 1000 Hz.

3. The printer of claim 1 wherein said vibration inducing element comprises a piezoelectric element.

4. The printer of claim 1 wherein said vibration inducing element comprises an electric motor.

5. The printer of claim 1 wherein said print elements comprise ink jet nozzles.

6. The printer of claim 5 wherein said vibration inducing element rotatingly vibrates said ink jet nozzles about an axis parallel to the carriage scan axis.

7. The printer of claim 6 wherein said vibration inducing element is attached to said print carriage.

8. The printer of claim 6 wherein said vibration inducing element vibrates at a frequency in the range of 100 Hz to 1000 Hz.

9. The printer of claim 6 wherein said vibration inducing element comprises a piezoelectric element.

10. The printer of claim 6 wherein said vibration inducing element comprises an electric motor.

11. A printer having reduced visible print banding, comprising:

a movable print carriage for scanning along a carriage scan axis;

a carriage slide structure for supporting the carriage for said scanning along the carriage scan axis, the slide structure including a slider rod having a longitudinal axis parallel to the carriage scan axis, the carriage being supported on the rod for sliding movement;

a carriage drive system coupled to the carriage for driving the carriage through said sliding movement along the slider rod;

a removable printhead supported by said movable print carriage during printing operations and having a plurality of printing elements for printing dots on print media in a print zone;

a print media handling system for advancing print media along a media scan axis to the print zone; and a carriage vibration inducing element attached to the carriage for causing said carriage to rotationally vibrate about the slider rod longitudinal axis such that locations along the media scan axis of the dots printed by said printing elements are minutely randomly varied to reduce visible print banding caused by less than optimum print media advance or by misdirection of the printing elements.

12. The printer of claim 11 wherein:

the carriage includes a wall structure;

the carriage slide structure includes a carriage bar, a guide arm attached to the carriage wall structure for engaging the carriage bar to prevent pivoting of the print carriage about the slider rod; and said carriage vibration inducing element is disposed between the guide arm and the wall structure to cause the carriage to rotationally vibrate about the slider rod.

13. The printer of claim 11 wherein said vibration inducing element vibrates at a frequency in a range of about 100 Hz to about 1000 Hz.

14. The printer of claim 11 wherein said vibration inducing element comprises a piezoelectric element.

15. The printer of claim 11 wherein said vibration inducing element comprises an electric motor.

16. A method of inkjet printing with reduced visible printing banding artifacts, comprising:

advancing a print medium along a media scan axis to a print zone;

scanning a print carriage along a carriage scan axis while supporting an inkjet printhead having a plurality of printing elements for printing dots on print media in the print zone;

vibrating the carriage relative to the print media in the print zone such that locations along the media scan axis of the dots printed by said printing elements are minutely randomly varied to reduce visible print banding caused by less than optimum print media advance or by misdirection of the printing elements.

17. The method of claim 16 further comprising supporting the carriage on a slider rod for sliding movement along the scan axis, and the step of vibrating the carriage includes causing said carriage to rotationally vibrate about the slider rod.

18. The method of claim 16 wherein said vibration is at a frequency in a range of about 100 Hz to about 1000 Hz.

19. A printer having reduced visible print banding, comprising:

a plurality of ink-jet printheads each comprising a nozzle array structure, each nozzle array structure having a plurality of printing elements for printing dots on print media in a print zone;

a movable print carriage for scanning along a carriage scan axis for mounting said plurality of replaceable printheads;

a carriage slide structure for supporting the carriage for said scanning along the carriage scan axis, the slide structure including a slider rod having a longitudinal axis parallel to the carriage scan axis, the carriage being supported on the rod for sliding movement;

a carriage drive system coupled to the carriage for driving the carriage through said sliding movement along the slider rod;

a print media handling system for advancing print media along a media scan axis to the print zone; and a carriage vibration inducing element attached to the carriage for causing said carriage to rotationally vibrate about the slider rod longitudinal axis such that locations along the media scan axis of the dots printed by said printing elements of said plurality of ink-jet printheads are minutely randomly varied to reduce visible print banding caused by less than optimum print media advance or by misdirection of the printing elements.

20. The printer of claim 19 wherein:

the carriage includes a wall structure;

the carriage slide structure includes a carriage bar, a guide arm attached to the carriage wall structure for engaging the carriage bar to prevent pivoting of the print carriage about the slider rod; and said carriage vibration inducing element is disposed between the guide arm and the wall structure to cause the carriage to rotationally vibrate about the slider rod.

21. The printer of claim 19 wherein said vibration inducing element vibrates at a frequency in a range of about 100 Hz to about 1000 Hz.

22. The printer of claim 19 wherein said vibration inducing element comprises a piezoelectric element.

23. The printer of claim 19 wherein said vibration inducing element comprises an electric motor.

24. The printer of claim 19 wherein said plurality of printheads includes a first printhead having a first nozzle array structure for printing dots of a first color, and a second printhead having a second nozzle array structure for printing dots of at least a second color.

* * * * *